United States Patent [19]

Keller

[11] 4,240,005

[45] Dec. 16, 1980

[54] APPARATUS FOR THE GENERATION OF PRIMARY ELECTRONS FROM A CATHODE

[75] Inventor: Roderich Keller, Darmstadt, Fed. Rep. of Germany

[73] Assignee: GSI Gesellschaft fuer Schwerionenforschung m.b.H., Darmstadt, Fed. Rep. of Germany

[21] Appl. No.: 60,764

[22] Filed: Jul. 26, 1979

[30] Foreign Application Priority Data

Sep. 29, 1978 [DE] Fed. Rep. of Germany ..... 2842506

[51] Int. Cl.[3] ..... H01J 1/15

[52] U.S. Cl. ..... 313/231; 313/341

[58] Field of Search ..... 313/231, 231.3, 231.4, 313/231.5, 341, 337, 362

[56] References Cited

PUBLICATIONS

Ardenne, "Tabellen zur Angewandten Physik", vol. 1, 2nd edition, p. 653, Berlin, 1962.

*Primary Examiner*—Palmer C. Demeo

*Assistant Examiner*—Darwin R. Hostetter

[57] ABSTRACT

Apparatus for generating primary electrons from a cathode. The apparatus is associated with a gas discharge chamber in which forced gas discharges are maintained and consists of a body carrying concentric conductors, one of which is a cylinder and the other of which extends through and beyond the cylinder and carries at its free end a plate-type cathode which is electrically connected to the cylinder by heating filaments extending therebetween and arranged behind the cathode plate.

8 Claims, 1 Drawing Figure

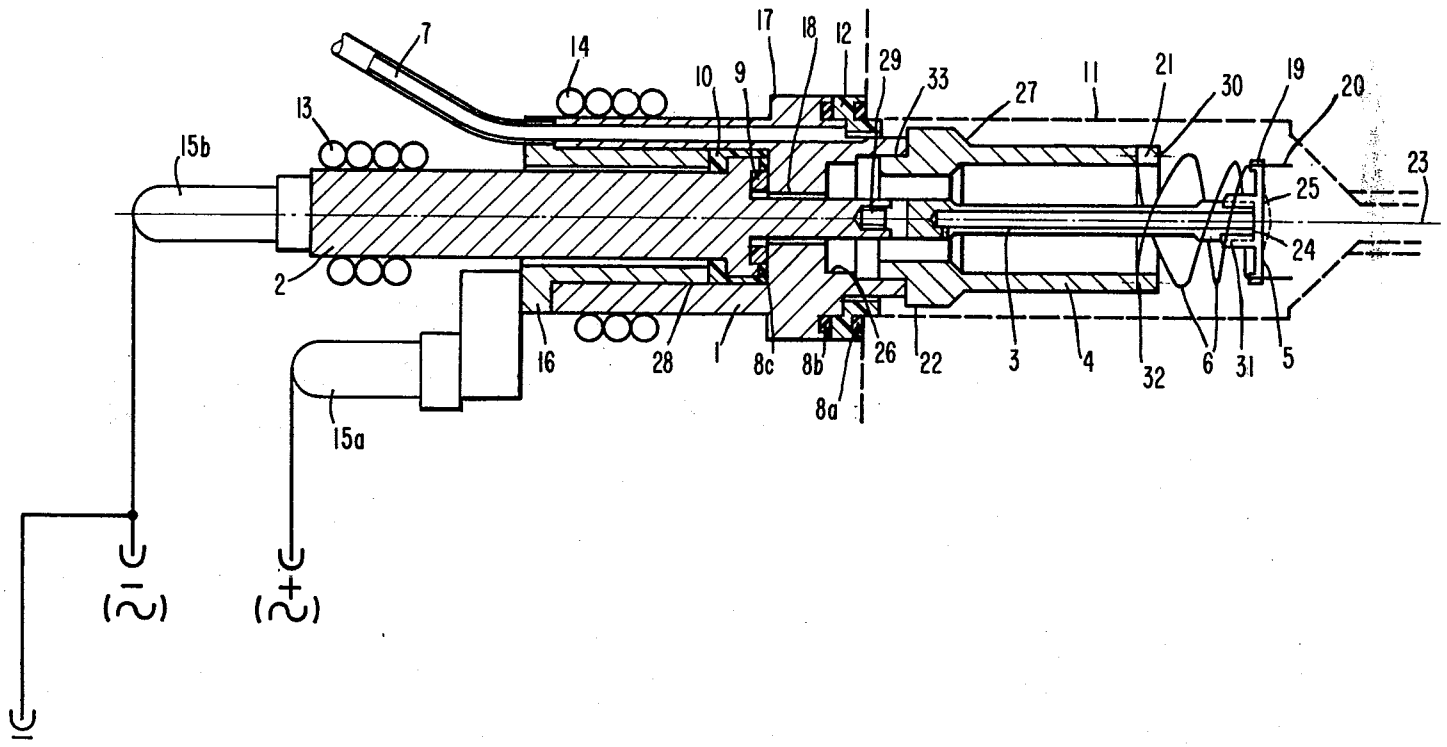
23
20
19
25
24
5
30
31
6
21
32
11
4
27
3
33
22
29
26
12
8a
18
8b
17
8c
9
1
10
28
14
16
7
15a
13
2
15b
+
−
1

APPARATUS FOR THE GENERATION OF PRIMARY ELECTRONS FROM A CATHODE

BACKGROUND OF THE INVENTION

1. Field of the Invention

The invention relates to an apparatus for the generation of primary electrons from a cathode for maintaining forced gas discharges and, more particularly, to a hybrid cathode for a duoplasmatron ion source.

2. Description of the Prior Art

Cathodes with filament-type emitters are known in the prior art (M. V. Ardenne, "Tabellen zur Angewandten Physik" Vol. 1, 2 edition, page 653, Berlin 1962). They have, however, a relatively short life span since the filament is rapidly worn by ion bombardment (cathode sputtering). As a result, the heating current has to be frequently adjusted to the reduced cross-section of the cathode filament if the filament becomes too weak as a result of overheating, shortenings of the filament windings may occur which would lead to an immediate destruction of the cathode. Also, the power supply feed throughs or penetrations usually used with such cathodes include ceramic materials which are very sensitive to temperature differentials particularly when subjected to the weight of the power supply cables. It is also difficult to keep them clear from metals condensing thereon so that short circuits may occur.

SUMMARY OF THE INVENTION

An apparatus for generating primary electrons from a cathode for maintaining forced gas discharges in a gas discharge chamber into which the apparatus is mounted consists of electrically insulated concentric body portions each of which carries a conductor. One of the conductors is a cylinder and the other is a rod or tube which extends centrally through and beyond the cylinder and carries at its free end a plate-type cathode. Heating filaments are arranged between the cylinder and the cathode so as to be disposed behind, and protected by, the cathode whose front face is exposed to ion bombardment. The body portions which are made from an electrically conductive material, are preferably cooled, thus permitting electrical insulation by plastic materials and vacuum sealing by Viton O-rings. In this way, no sensitive ceramic feed-throughs or penetrations are necessary. The cathode, in the form of a solid plate which can withstand ion bombardment and the heating filaments which are exposed only to relative little ion bombardment, have a relatively long life.

BRIEF DESCRIPTION OF THE DRAWING

The sole FIGURE shows a cathode according to the invention in an axial cross-sectional view.

DESCRIPTION OF THE PREFERRED EMBODIMENT

A cathode which may be termed hybrid cathode is of co-axial design and consists essentially of outer and inner main body portions 1 and 2, power supply conductors 3 and 4 for a plate-type emitter 5 and heating filaments 6.

The outer body portion 1 has a pipe 7 extending therethrough at one side thereof, which pipe 7 provides for communication with a gas discharge chamber 11 for the admission of operating gas thereto. Interposed between the outer body portion 1 and the discharge chamber 11 is an annular insulating member 12 with O-rings

8*a, b,* disposed at both ends to provide vacuum seals. The body portions 1 and 2 are also coaxial with the axis 23 of the apparatus. An insulating ring member 9 and a centering sleeve 10 of an insulating material are disposed between the body portions 1 and 2 to electrically insulate the cathode heating power supply conductors from each other. An additional O-ring 8*c* is arranged between the body portions 1 and 2 as a seal therebetween. The annular insulating member 12 between the body portion 1 and the gas discharge chamber 11 also serves to center the apparatus in the discharge chamber 11.

The body portions 1 and 2 are provided with contact members 15*a* and 15*b* for connection of electric heating power supply cables. With two tungsten filaments of 0.8 mm diameter and 85 mm length, the voltage of the power supply is ca. 8 volts; the current rating is about 80 amperes. The negative pole of the discharge power supply may be connected to either of the two contact members 15*a,* 15*b.*

Both body portions 1 and 2 have cooling means associated therewith such as cooling coils 14 and 13, the cooling coils being soldered to the body portions for good heat removal. The centering sleeve 10 may be split so that it can be mounted on the inner body portion 2 after the mounting and soldering of the cooling coil 13. Another tubular member 16 which is also split, or which is placed over the inner body portion 1 before the cooling coil 13 is soldered thereto, is threaded into the outer body portion 2 by means of a thread 28 and abuts the centering sleeve 10 thereby holding together the inner and outer body portions 1 and 2.

The cathode as a whole is mounted to the discharge chamber 11 by means of a support plate which is not shown but which engages a flange 17 on the outer body portion 1. A second flange 18 is provided at the inner side 26 of the body portion 1 which protects the insulating ring member from the deposition of metal vapors from the discharge chamber 11.

The outer body portion 1 is hollow and the inner body portion 2 is mounted therein and carries a central power supply conductor 3 consisting of a tube or rod connected to the inner body portion 2 by a thread 29. The tube 3 is arranged concentrically within a cylindrical conductor 4 mounted on the outer body portion 1. The inner conductor 3 protrudes axially beyond the front end 30 of the cylindrical conductor 4. It may consist of a highly temperature resistant metal tube having thin walls over much of its length or it may consist of a solid graphite rod. The emitter or cathode 5 is mounted on the central conductor 3 by a threaded portion 31 and in this way is mechanically firmly held in position but is not unduly cooled.

The emitter 5 has at its circumference axial openings 19 which receive the ends of one or more heating filaments 6 consisting of tungsten wire such that the wire ends 20 extend about 5 mm beyond the face 25 of the emitter 5 and have pointed tips. This arrangement facilitates initiation of the discharge in the discharge chamber 11 which is especially advantageous if the cathode is used in pulsed discharges.

The plate-type cathode 5 consists of tantalum or molybdenum and it may be of increased thickness in its center portion if the ions hit the plate preferably in the center as is the case for example in a duoplasmatron.

The heating filaments 6 consist preferably of tungsten because tungsten emits substantially fewer electrons than tantalum or molybdenum at a given temperature and because it is mechanically much stronger. The rear end of each heating filament 6 is suitably bent to form a loop 32 which is clamped against the outer cylindrical conductor 4 by means of a clamp ring 21 bolted onto the conductor 4. The cylindrical conductor 4 itself is threaded into the outer body portion 1 with a thread 33 and has as its outer circumference 27 a flange portion 22 which protects the annular insulating member 12 from metal vapor depositions from the gas discharge chamber 11.

The cathode disclosed herein is a hybrid cathode which is especially suitable for use in a duoplasmatron ion source. Other applications, however, are possible and for such other applications it may be desirable to change the relationships of diameter, length and thickness of the various parts so as to achieve optimum performance. Other materials such as Elkonite, copper, stainless steel, may be used for the body portions 1 and 2; molybdenum or tungsten tubes or graphite rods may be used as power supply conductors 3; tantalum or molybdenum may be used as material for the emitter or cathode 5 and tungsten wires of 0.8 mm diameter and 85 mm length may for example be used for the heating coils 6. The power supply conductor 4, that is the cylinder coaxially surrounding the inner power supply conductor 3 and the clamping ring 21 may consist of molybdenum or stainless steel. The cooling coils 13 and 14 as well as the gas admission pipe 7 consist of stainless steel or copper and are soldered or brazed into or on the body portions 1 and 2. The insulating members 9 and 12 and the sleeve 10 consist of glass-ceramic materials, Teflon, Vespel or Trovidur and the O-rings 8 consist of Viton.

A particular advantage of the arrangement according to the present invention is seen in a greatly increased lifespan of the cathode. The emitter, which consists of a plate of substantial thickness and which is supported by a power supply conductor with a relatively low heat conduction, can withstand the ion bombardment over a relatively long period without substantial change in its operation. The coiled heating filaments are still relatively stiff at the given operating temperature so that short-circuits between coil windings are avoided. They also emit ions to a lesser degree than the plate. Heat of the filaments is transmitted to the plate by direct contact. The ends of the filaments or coils which protrude beyond the plate toward the anode of the discharge wall further insure that the discharge is readily initiated which is of particular importance for pulsed operations.

Another advantage of the present invention is seen in the reliability achieved by the described arrangement: As the body portions of the cathode consist of materials with good heat conductivity and as they are cooled it is possible to use O-rings as vacuum seals and plastic materials as insulating materials. Also, the insulators are protected from metal vapor deposits by suitable flanges. They may also easily be replaced if this should become necessary.

The arrangement according to the present invention achieves in a simple manner, that the heat necessary for electron emission is generated at a place separate from the place of electron emission without incurring the disadvantages associated with indirect heating. At the same time, the emitter plate protects the heating filaments or coils from the destructive ion bombardment. Further, the energy of the ions striking the emitter plate is also converted into heat in a controlled manner such that the present arrangement may be termed resistance—and plasma heated hybrid-cathode.

In summary, the outstanding advantages of the present invention are long life as compared with cathodes in which the heating filaments are also ion emitters and great mechanical rigidity; there is no penetration of the metal conductors through ceramic material; there is a high reliability because vapor deposition on the insulating members is prevented and winding shorts of the heating filaments do not occur. Finally, maintenance of constant operating conditions is possible for ca. 155–200 hours since the cross-section of the heating filaments diminishes only very slowly.

I claim:

1. Apparatus for generating primary electrons from a cathode for maintaining forced gas discharges, said apparatus comprising a body; concentric energy supply conductors mounted on said body, the first of said conductors being a hollow cylinder and the second conductor extending centrally through and beyond said cylinder and carrying said cathode at its free end, said cathode being in the form of a plate having an electron discharge face; and at least one heating filament electrically connected between said cathode and said cylinder.

2. Apparatus as recited in claim 1, wherein said second conductor is a solid rod.

3. Apparatus as recited in claim 1, wherein said second conductor is a tube.

4. Apparatus as claimed in claim 1, wherein said body consists of two concentric body portions which are electrically insulated from each other, the outer of said body portions carrying said hollow cylindrical first conductor and the inner of said body portions carrying said central second conductor, each being mechanically and electrically connected to the respective body portion and each body portion having an electrical contact member associated therewith.

5. Apparatus as recited in claim 1, wherein said cathode is in the form of a disk with openings therein and at least one of said heating filament wires extends through an opening in said disk, protrudes beyond said disk and has a pointed tip so as to form a discharge point.

6. Apparatus as recited in claim 4, wherein said inner body portion is mounted into said outer body portion with a first insulating structure disposed between said inner and outer body portions and said outer body portion is mounted into the wall of a gas discharge chamber with a second insulating structure arranged therebetween, said outer body portion having an inwardly projecting flange arranged adjacent said first insulating structure and said cylindrical conductor having an outwardly protecting flange arranged adjacent said second insulating structure for protecting said insulating structures from metal vapor depositions.

7. Apparatus as recited in claim 4, wherein at least one of said body portions has cooling means associated therewith so as to permit cooling of said body portions.

8. Apparatus as recited in claim 4, wherein a gas admission pipe extends through the outer body portion for admission of operating gas to a gas discharge chamber into which said apparatus is mounted.

* * * * *